US006957490B2

(12) United States Patent
Wilcox

(10) Patent No.: US 6,957,490 B2
(45) Date of Patent: Oct. 25, 2005

(54) DRIVE SYSTEM FOR BEARD AND MUSTACHE TRIMMER

(75) Inventor: John Wilcox, Newport, RI (US)

(73) Assignee: Rovcal, Inc., Madison, WI (US)

( * ) Notice: Subject to any disclaimer, the term of this patent is extended or adjusted under 35 U.S.C. 154(b) by 112 days.

(21) Appl. No.: 10/200,468

(22) Filed: Jul. 18, 2002

(65) Prior Publication Data

US 2003/0029042 A1 Feb. 13, 2003

Related U.S. Application Data

(60) Provisional application No. 60/307,477, filed on Jul. 24, 2001.

(51) Int. Cl.[7] ..... B26B 19/10; B26B 19/38

(52) U.S. Cl. ..... 30/34.1; 30/43.92; 30/210; 30/216

(58) Field of Search ..... 30/34.1, 34.05, 30/42, 43.1, 43.9, 43.92, 44, 45, 208, 209, 210, 215, 216, 228

(56) References Cited

U.S. PATENT DOCUMENTS 2,793,430 A * 5/1957 Carissimi ..... 30/43.92
3,714,710 A * 2/1973 Daniels et al. ..... 30/34.1
3,763,558 A * 10/1973 Bauerle ..... 30/34.1
3,844,035 A * 10/1974 Bauerle ..... 30/43.92
3,909,938 A * 10/1975 Brenneman et al. ..... 30/34.1
3,911,572 A * 10/1975 Czerner et al. ..... 30/34.1
3,991,464 A * 11/1976 Ihasz ..... 30/34.1
4,426,776 A * 1/1984 Kakumoto et al. ..... 30/34.1
4,505,036 A * 3/1985 Ochiai et al. ..... 30/34.1
4,509,259 A * 4/1985 Kakumoto et al. ..... 30/34.1
4,719,698 A * 1/1988 Ninomiya et al. ..... 30/43.6
4,803,780 A * 2/1989 Locke et al. ..... 30/34.1
4,926,552 A * 5/1990 Otsuka et al. ..... 30/43.92
5,022,153 A * 6/1991 Baron ..... 30/34.1
5,050,300 A * 9/1991 Miska ..... 30/34.1
5,701,673 A * 12/1997 Ullmann et al. ..... 30/34.1
5,946,806 A * 9/1999 Watanabe et al. ..... 30/43.92
6,601,302 B2 * 8/2003 Andrew ..... 30/34.1

* cited by examiner

*Primary Examiner*—Clark F. Dexter
(74) *Attorney, Agent, or Firm*—Melvin I. Stoltz

(57) ABSTRACT

By providing a beard and mustache trimmer construction wherein a single motor driven element is employed for directly operating both the main cutting blades as well as a pop-up trimmer, an easily employed, efficient, beard and mustache trimmer is realized. The trimmer is constructed in a manner which enables the pop-up trimmer to be directly driven by the same element which drives the principal cutting blades. In this way, greater power is delivered to the pop-up trimmer element than has otherwise been attained with prior art systems as well as providing substantially reduced noise levels. As a result, a substantially enhanced cutting and trimming system is realized.

7 Claims, 4 Drawing Sheets

DRIVE SYSTEM FOR BEARD AND MUSTACHE TRIMMER

RELATED APPLICATIONS

This application is related to U.S. Provisional Patent Application Ser. No. 60/307,477, filed Jul. 24, 2001 entitled DRIVE SYSTEM FOR BEARD AND MUSTACHE TRIMMER.

TECHNICAL FIELD

This invention relates to beard and mustache trimmers and, more particularly, to beard and mustache trimmers incorporating small, pop-up trimmer elements.

BACKGROUND ART

Over the last several years, individuals have been increasingly drawn to the advantages provided by electric dry shavers and beard and mustache trimmers. In general, the consuming public has found that the use of razors or other systems is extremely inconvenient for removing or shaving long hair and/or short hair or stubble, as commonly found in men's beards. In addition, with the ever increasing time constraints and commitments individuals typically encounter, a fast and effective shaving system is most desirable.

The discomfort as well as the time consumed in using shaving creams, soaps and gels, in order to provide a medium for which a razor can be used, requires more time and inconvenience than most individuals are willing or capable of experiencing. Furthermore, the cost of maintaining a sufficient supply of these products creates an additional burden. Consequently, electric dry shavers and beard and mustache trimmers have become increasingly popular, as well as battery-operated electric dry shavers and trimmers which can withstand exposure to moisture, thereby enabling individuals to simultaneously shower, as well as shaving their beards.

As the popularity of using electric dry shavers increased, numerous product designs with alternate constructions proliferated, in an attempt to improve and enhance the comfort and cutting efficiency of such shavers and trimmers. However, in spite of these products, difficulties have continued to exist in providing optimum results with optimum comfort.

In the area of use relating to beards and mustaches, electric trimmers have become increasingly popular. In general, these beard and mustache trimmers incorporate two cooperating cutting blades, each of which comprise a plurality of cutting teeth. By mounting the cutting blades in overlying cooperating engagement, with one blade being stationary and the other blade movable relative thereto, the desired cutting action is achieved.

In addition, these prior art beard and mustache trimmers also incorporate a comb member or element which co-operates with the cutting blades and is telescopically movable relative thereto. In this way, the length of the hair being cut by the cutting blades is precisely controlled.

Although beard and mustache trimmers of this nature have become increasingly popular and have been constructed in a wide variety of alternate configurations, difficulties have been encountered with many of these prior art constructions. In particular, prior art beard and mustache trimmers have been incapable of providing precise, detail cutting of specific areas, even though such areas are commonly found on certain beards and mustaches.

In an attempt to satisfy this consumer need, some prior art beard and mustache trimmers incorporate a small, separate, pop-up trimmer member which can be activated whenever desired by the user. This small pop-up trimmer is employed for providing the fine detail work sought by consumers.

Although these small, pop-up trimmers have been employed on some prior art beard and mustache trimmers, the drive system required for activating and operating the pop-up trimmer has been costly and cumbersome. In addition, a substantial increase in noise is also generated by the incorporation of pop-up trimmers, as well as a loss of power to the pop-up trimmer, due to the linkages required to achieve activation and operation of the pop-up trimmer.

Consequently, it is a principal object of the present invention to provide a hair cutting and trimming system for beards and mustaches which incorporates a small, pop-up trimmer element which is easily activated and inexpensive to produce.

Another object of the present invention is to provide a hair cutting and trimming system for beards and mustaches having the characteristic features described above which is constructed in a manner wherein a single motor driven drive element is employed for operating both the main cutting blades and the pop-up trimmer.

A further object of the present invention is to provide a hair cutting and trimming system for beards and mustaches having the characteristic features described above which provides a pop-up trimmer having a direct linkage to the drive system and operates without any reduction of the power.

A still further object of the present invention is to provide a hair cutting and trimming system for beards and mustaches having the characteristic features described above which operates without any increase in the noise level when the pop-up trimmer is engaged.

Other and more specific objects will in part the obvious and will in part appear hereinafter.

SUMMARY OF THE INVENTION

By employing the present invention, all the difficulties and drawbacks found in prior art beard and mustache trimmers has been eliminated and an efficient, easily employed beard and mustache trimmer with an easily employed, efficient pop-up trimmer is realized. These goals are attained by providing a construction wherein a single motor driven drive element is employed for directly operating both the main cutting blades as well as the pop-up trimmer.

By constructing the trimmer in a manner which enables the pop-up trimmer to be directly driven by the same element which drives the principal cutting blades, a substantially improved beard and mustache trimmer construction is realized. In particular, greater power is delivered to the pop-up trimmer elements than has otherwise been attained with prior art systems as well as providing substantially reduced noise levels. As a result, a substantially enhanced system is realized.

In the preferred construction, the cutting blades of the beard and mustache trimmer incorporate a fixed cutting blade and a movable cutting blade cooperatively associated with each other. In addition, the movable cutting blade is controlled by engaging a rotationally driven, eccentrically mounted pin in a movement control member which is mounted to the movable blade and incorporates an enlarged pin receiving zone.

In addition, in order to enable the use of a single drive motor, a pop-up trimmer is provided which is pivotally mounted to the housing of the beard and mustache trimmer which is movable between a first stored position and a second deployed and usable position. In addition, the pop-up trimmer incorporates a drive arm having a free end which is movable into and out of engagement with the movement control member.

In the preferred construction, the free end of the drive arm is positioned for engaging in and disengaging from the enlarged pin receiving zone of the movement control member simultaneously with the arcuate pivoting movement of the pop-up trimmer. In this way, an easily constructed beard and mustache trimmer assembly is realized which enables the user to achieve fine or detailed trimming of any desired area while employing a trimmer element which is driven directly by a single motor without any reduction of power or increase of noise level.

The invention accordingly comprises the features of construction, combination of elements and arrangement of parts which will be exemplified in the construction hereinafter set forth, and the scope of the invention will be indicated in the claims.

THE DRAWINGS

For a fuller understanding of the nature and objects of the invention, reference should be had to the following detailed description taken in connection with the accompanying drawings, in which.

Figure 4:
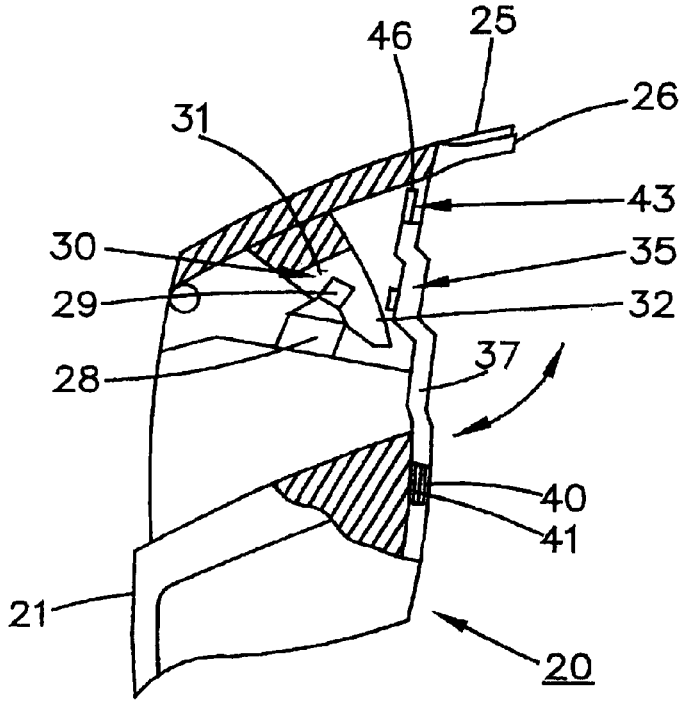
Figure 5:
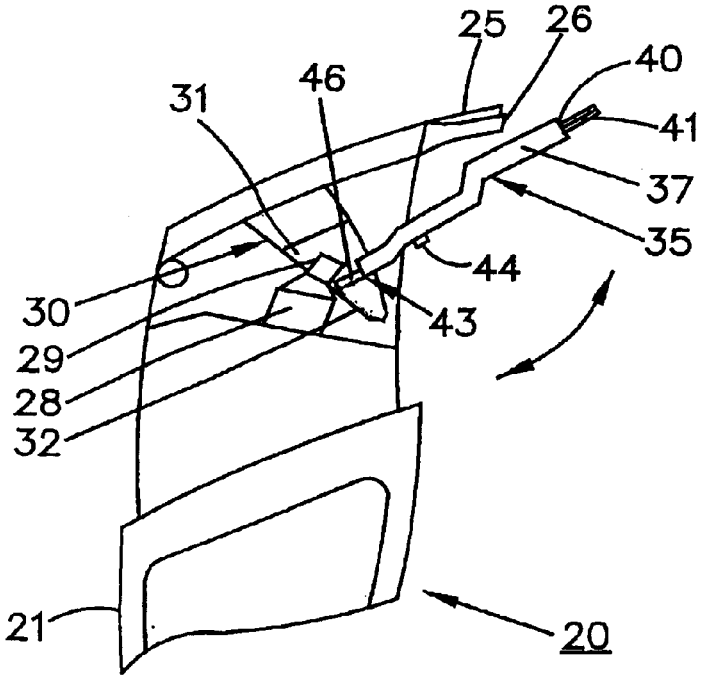

FIG. 4 is a cross-sectional side elevation view, partially broken away, of the drive system for the beard and mustache trimmer of the present invention with the pop-up trimmer in the down position; and FIG. 5 is a cross-sectional side elevation view, partially broken away, of the drive system for the beard and mustache trimmer of the present invention with the pop-up trimmer in the raised position.

DETAILED DISCLOSURE

By referring to FIGS. 1–5, along with the following detailed discussion, the construction and operation of beard and mustache trimmer 20 of the present invention can best be understood. In this disclosure, the preferred embodiment for the present invention is fully detailed. However, alternate embodiments may be employed without departing from the scope of the present invention. Consequently, it is to be understood, that the following disclosure of the preferred embodiment is for exemplary purposes only and is not intended as a limitation of the present invention.

Figure 1:
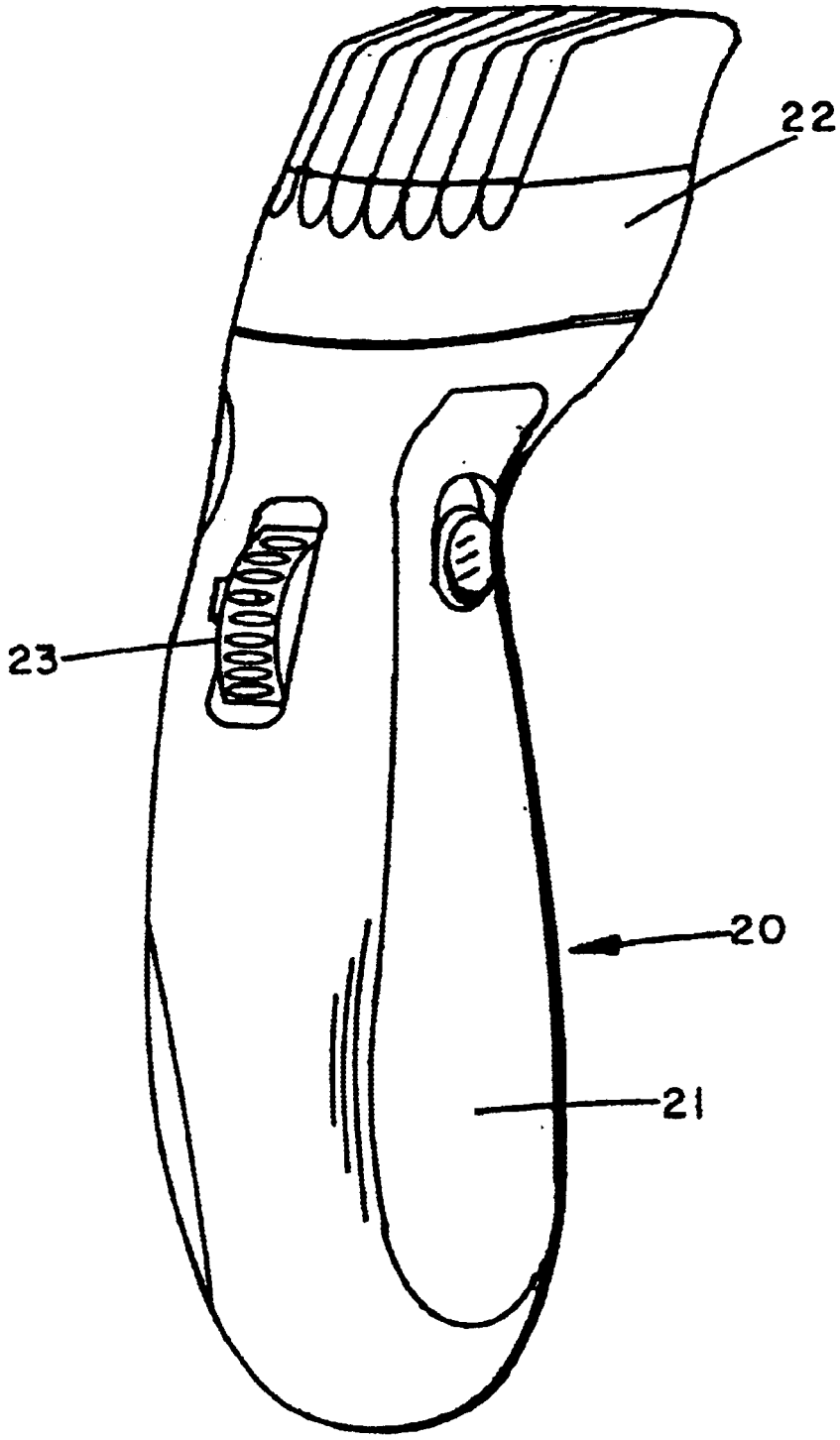
FIG. 1 is a perspective view of the beard and mustache trimmer of the present invention.

As depicted in FIG. 1, beard and mustache trimmer 20 comprises an elongated housing 21 which is constructed for being easily held by the user. In addition, comb element 22 is mounted to the forward end of housing 21 and is constructed for being controllably movable relative thereto in response to the rotational movement of wheel element 23.

Figure 2:
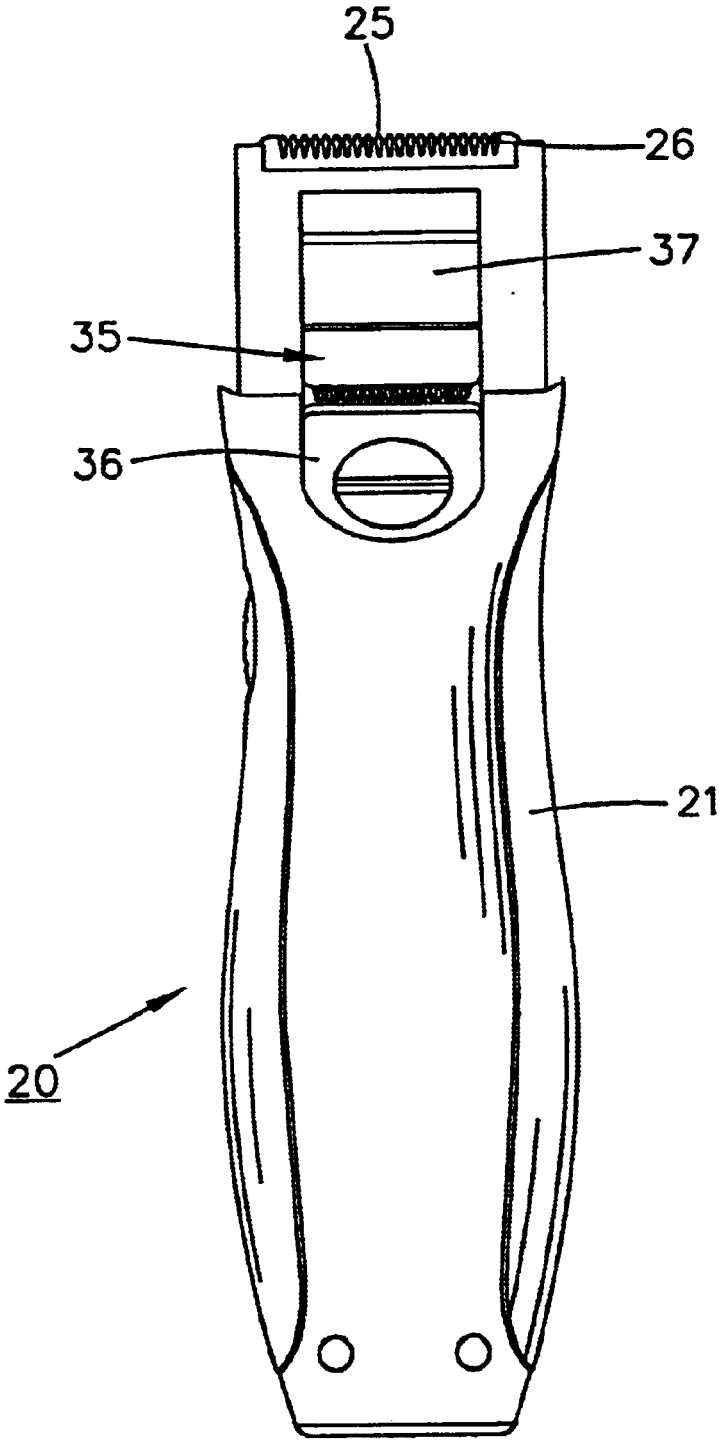
FIG. 2 is a rear elevation view of the beard and mustache trimmer of the present invention with the comb element removed and the pop-up trimmer in the down position.

As best seen in FIG. 2, the principal cutting action for beard and mustache trimmer 20 is provided by substantially flat cutting blades 25 and 26. In order to provide the desired cutting action for beard and mustache trimmer 20, cutting blade 25 remains stationary, while cutting blade 26 is reciprocatingly driven in cooperating engagement with cutting blade 25. In this way, the cutting teeth formed into blades 25 and 26 continuously move relative to each other, providing the desired cutting of the hair fibers. In addition, by telescopically moving comb element 22 relative to housing 21 and cutting blades 25 and 26, the length of the hair fibers being cut is precisely controlled.

Figure 3:
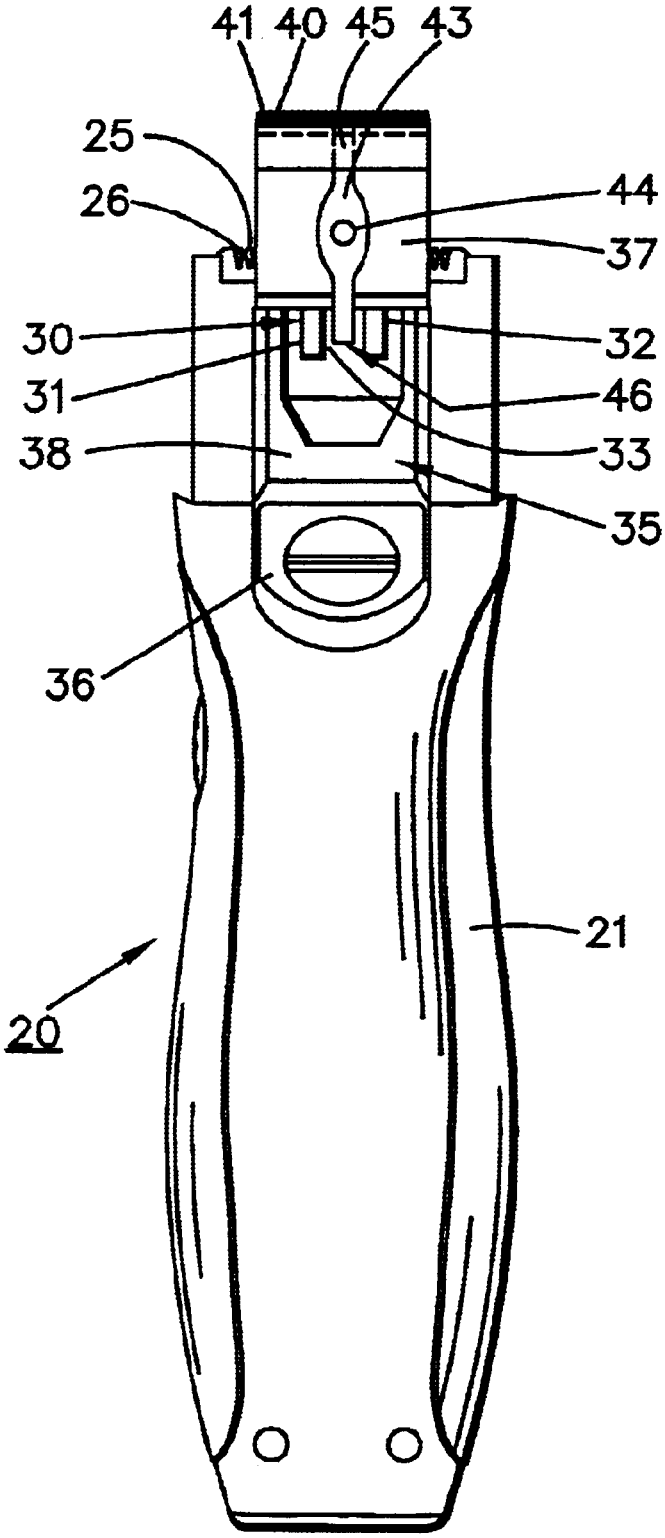
FIG. 3 is a rear elevation view of the beard and mustache trimmer of FIG. 2, with the pop-up element in the raised position.

As shown in FIGS. 3–5, the desired movement of cutting blade 26 relative to stationary cutting blade 25 is provided by a motor, not shown, which continuously rotates shaft 28 on which drive pin 29 is eccentrically mounted. This blade driving construction is completed by employing movement control element 30 which is affixed to cutting blade 26 and extends therefrom into engagement with drive pin 29. In this way, as shaft 28 continuously rotates, whenever the motor is activated, eccentrically mounted pin 29 rotates therewith, continuously moving control element 30 and cutting blade 26.

As depicted, movement control element 30 comprises two juxtaposed, spaced, facing finger members 31 and 32 which cooperate with each other to form pin engaging recess 33 therebetween. When movement control element 30 is in its operating position, drive pin 29 is mounted within recess 33, sandwiched between finger members 31 and 32. As shaft 28 rotates, drive pin 29 causes movement control element 30 to continuously move in a generally side to side manner, causing cutting blade 26 to continuously reciprocate relative to fixed cutting blade 25. In this way, the desired cutting action is realized.

As discussed above, the incorporation of a pop-up trimmer with a beard and mustache trimmer has been found to be extremely desirable in order to enable precise, detailed cutting of beards and mustaches is to be achieved. In the preferred embodiment of the present invention, beard and mustache trimmer 20 incorporates pop-up trimmer assembly 35.

In the preferred construction, pop-up trimmer trimmer assembly 35 comprises an activation button 36 and a pivotable blade carrying panel 37. As shown in FIGS. 2 and 4, when in the down or stowed position, pop-up trimmer assembly 35 is mounted in nested inter-engagement with housing 21, preferably recessed behind comb element 22. However, whenever pop-up trimmer assembly 35 is to be employed, comb element 22 is removed and activating button 36 is advanced upwardly, causing blade carrying panel 37 to arcuately pivot from its stowed position to its fully extended and exposed position, as shown in FIGS. 3 and 5. In order to achieve this arcuate pivoting movement of blade carrying panel 37, interconnecting or linking plate 38 is employed, which is cooperatingly engaged with activation button 36 and blade carrying panel 37.

In its preferred construction, blade carrying panel 37 comprises small, detail oriented, generally planar, trimmer blades 40 and 41 constructed for cooperating with each other. As with cutting blades 25 and 26, trimmer blades 40 and 41 are mounted in overlying cooperating engagement, with blade 40 being fixed or immovable, while blade 41 is reciprocatingly movable in a generally side-to-side manner relative to blade 40. In this way, the cutting teeth of trimmer blades 40 and 41 cooperate with each other to provide the desired detailed cutting action.

In order to attain the desired movement with the resulting cutting action, pivot arm 43 is mounted to panel 37, with first end 45 thereof engaged with trimmer blade 41. In the preferred construction, pivot arm 43 is mounted to panel 37 about post 44, which establishes the pivot axis about which arm 43 is able to move. In addition, in accordance with the present invention, pivot arm 43 is constructed to cooperate with movement control element 30 in order to provide the desired directly driven, controlled movement of trimmer blade 41.

As best seen in FIGS. 3 and 5, finger members 31 and 32 of movement control element 30 are constructed to extend beyond drive pin 29 towards pop-up trimmer assembly 35. As a result of this construction, second end 46 of pivot arm 43 is moved into direct engagement within recess 33 of movement control element 30 whenever pop-up trimmer assembly 35 is moved into its operating position.

With second end 46 of pivot arm 43 retained in recess 33 established by finger members 31 and 32 of movement control element 30, any activation of the motor, which causes movement control element 30 to be operative, also causes pivot arm 43 to arcuately pivot about the axis defined by post 44. This side-to-side movement causes trimmer blade 41 to be moved in a similar side-to-side manner relative to stationary trimmer blade 40, thereby providing the desired detailed trimming action.

In addition to providing the desired precision cutting, the construction employed in the present invention for pop-up trimmer assembly 35 also achieves direct, linkage-free movement of pivot arm 43 for causing trimmer blade 41 to be driven in the desired manner. By achieving this direct drive of trimmer blade 41 relative to trimmer blade 40, all of the prior art difficulties and drawbacks are overcome and a low noise, vibration-free, pop-up trimmer construction is realized, with substantially enhanced power being delivered to cutting blade 41.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by Letters Patent is:

1. A hair cutting and trimming system constructed for providing cutting of any desired hair length, said cutting and trimming system comprising:

A. a housing;

B. a first hair cutting blade fixedly mounted to the housing;

C. a second hair cutting blade movably mounted to the housing in cooperating association with the first hair cutting blade for producing hair cutting action therewith;

D. a movement control member a. comprising two finger members positioned in juxtaposed, spaced, cooperating relationship with each other, defining a spaced zone therebetween, and b. mounted to said second movable hair cutting blade for causing said second hair cutting blade to reciprocatingly move in a side to side manner relative to the first hair cutting blade;

E. drive means a. mounted in said housing in cooperating association with the movement control member for continuously driving the movement control member whenever the drive means is activated, and b. comprising a rotationally driven eccentrically mounted pin positioned for engagement in said spaced zone formed between the two finger members;

F. a hair trimming assembly constructed for providing fine or detailed trimming of specific areas, said hair trimming assembly a. being mounted to the housing, b. movable between a first OFF position and a second ON position, c. comprising a pair of hair trimming blades, the first of said pair of hair trimming blades being fixedly mounted and the second of said pair of hair trimming blades being movably mounted in cooperating relationship with the first hair trimming blade, and d. a separate and independent pivot arm pivotally mounted to the hair trimming assembly, said pivot arm being 1). secured at a first end to the second, movable hair trimming blade for controllably moving the second hair trimming blade in the desired side to side reciprocating manner, and 2). positioned for engaging the spaced zone between the two finger members of the movement control member with a second end thereof when the hair trimming assembly is in its second, ON position, and said second end being disengaged from the movement control member when the hair trimming assembly is in its first, OFF position;

whereby the single rotational movement of the eccentrically mounted pin simultaneously directly drives both the movement control member and the pivot arm whenever the hair trimming assembly is in its second ON position.

2. The hair cutting and trimming system defined in claim 1, wherein the hair trimming assembly comprises a support panel pivotally mounted to the housing and movable between said first OFF position and said second ON position.

3. The hair cutting and trimming system defined in claim 2, wherein said first and second hair trimming blades are mounted to the support panel for being stowed and non-usable when the panel is in its first position and being positioned for use whenever the panel is in its second position with said pivot arm being engaged with the movement control member for causing the second hair trimming blade to be operational.

4. The hair cutting and trimming system defined in claim 3, wherein said pivot arm is further defined as comprising 3). an elongated shaft pivotally mounted to the panel with a pivot axis formed in the central zone thereof, 4). a first end of said shaft being fixedly mounted to the second, movable, hair trimming blade, and 5). a second end of said shaft being movably positionable between engagement in the spaced zone formed between the two finger members of the movement control member, when said panel is in its second position, and disengagement from the spaced zone whenever the panel is in its first position.

5. The hair cutting and trimming system defined in claim 3, wherein said movement control member is further defined as extending from the second hair cutting blade and comprising an enlarged receiving zone position for cooperating, engaged association with the drive means and one end of the pivot arm when said pivot arm is in its second position.

6. The hair cutting and trimming system defined in claim 3, wherein the movement of the support panel is controlled by the movement of a finger operatable button.

7. The hair cutting and trimming system defined in claim 3, wherein the pair of hair trimming blades formed in the hair trimming assembly each comprise an overall width substantially smaller than the overall width of the first and second hair cutting blades for enabling smaller, limited, more detailed cutting of any desired area.

* * * * *